US008647145B2

(12) United States Patent
Liu

(10) Patent No.: US 8,647,145 B2
(45) Date of Patent: Feb. 11, 2014

(54) COMMUNICATION CONNECTOR HAVING A COVER MOVABLE ALONG AN INCLINE RELATIVE TO A CASE

(75) Inventor: Bo-Wen Liu, New Taipei (TW)

(73) Assignee: Wistron Corporation, New Taipei (TW)

( * ) Notice: Subject to any disclaimer, the term of this patent is extended or adjusted under 35 U.S.C. 154(b) by 31 days.

(21) Appl. No.: 13/541,548

(22) Filed: Jul. 3, 2012

(65) Prior Publication Data

US 2013/0065421 A1 Mar. 14, 2013

(30) Foreign Application Priority Data

Sep. 13, 2011 (TW) ..... 100132862 A

(51) Int. Cl.
*H01R 33/00* (2006.01)

(52) U.S. Cl.
USPC ..... 439/374

(58) Field of Classification Search
USPC ..... 439/367–374
See application file for complete search history.

(56) References Cited

U.S. PATENT DOCUMENTS

| | | | | |
|---|---|---|---|---|
| 5,975,929 | A * | 11/1999 | Matsuura et al. | 439/157 |
| 6,045,384 | A * | 4/2000 | Norizuki et al. | 439/310 |
| 6,984,144 | B1 * | 1/2006 | Nelson et al. | 439/374 |
| 7,815,464 | B2 * | 10/2010 | Kim | 439/490 |
| 7,862,353 | B1 * | 1/2011 | Azad et al. | 439/157 |
| 2006/0223358 | A1 * | 10/2006 | O'connell et al. | 439/373 |
| 2011/0165790 | A1 * | 7/2011 | Tagawa et al. | 439/374 |

FOREIGN PATENT DOCUMENTS

| | | |
|---|---|---|
| TW | 490102 | 6/2002 |

* cited by examiner

*Primary Examiner* — Chandrika Prasad
(74) *Attorney, Agent, or Firm* — Muncy, Geissler, Olds & Lowe, PLLC

(57) ABSTRACT

A communication connector for connecting with a communication plug is disclosed. The communication connector includes a base, a set of conductive terminals, a case, and a cover, wherein the set of conductive terminals is situated on the base, and the case is used for accommodating the base and the set of conductive terminals. The case has a first incline with an opening. The cover has a second incline and a notch. The shape of the second incline matches the first incline to allow the cover to move upward or downward relative to the case. The shape of the notch matches the communication plug. When the cover moves upward, the communication plug passes the notch, enters the opening, and electrically connects to the set of conductive terminals.

10 Claims, 3 Drawing Sheets

COMMUNICATION CONNECTOR HAVING A COVER MOVABLE ALONG AN INCLINE RELATIVE TO A CASE

BACKGROUND OF THE INVENTION

1. Field of the Invention

The present invention relates to a communication connector; more particularly, the present invention relates to a communication connector that can be applied to a thin electronic device.

2. Description of the Related Art

As technology develops, electronic devices have become thinner to meet users' requirements. However, some thick connectors for video outputs or networks, such as VGA or RJ45, cannot be applied to thin electronic devices because of the thickness of these connectors. Therefore, thin electronic devices cannot transmit a network signal via a wired network connection. Although the wireless network connection can be used as an alternative for thin electronic devices, the wireless network connection can only be used in a wireless environment, which is inconvenient to users. According to current network service demands, the wired network cannot be completely replaced with a wireless network, so there is a need to solve the problem of the thickness of the communication connector for allowing the communication connector to be installed in thin electronic devices.

In order to solve the problem of the thickness of the communication connector, a flip-cover network connector is disclosed. The network plug has to be plugged conversely for connecting to the flip-cover network connector; however, plugging in the network plug conversely is not the normal practice for users. Moreover, an external network connector for connecting to a USB port is also disclosed; users have to always carry the external network connector together with the thin electronic device to use the wired network.

In conclusion, the network connectors of the prior are inconvenient to use; therefore, there is a need to provide a new network connector to solve the problem of the prior art.

SUMMARY OF THE INVENTION

It is an object of the present invention to provide a communication connector applied to a thin electronic device.

To achieve the abovementioned object, the communication connector of the present invention for connecting with a communication plug is disclosed. The communication connector includes a base, a set of conductive terminals, a case, and a cover, wherein the set of conductive terminals is situated on the base; the case is used for accommodating the base and the set of conductive terminals. The case has a first incline with an opening. The cover has a second incline and a notch. The shape of the second incline matches the first incline to allow the cover to move upward or downward relative to the case. The shape of the notch matches the communication plug. When the cover moves upward, the communication plug passes the notch, entering the opening, and electrically connects to the set of conductive terminals.

In one embodiment of the present invention, the communication connector of the present invention is an RJ45 connector.

DETAILED DESCRIPTION OF THE PREFERRED EMBODIMENT

These and other objects and advantages of the present invention will become apparent from the following description of the accompanying drawings, which disclose several embodiments of the present invention. It is to be understood that the drawings are to be used for purposes of illustration only, and not as a definition of the invention.

Figure 1:
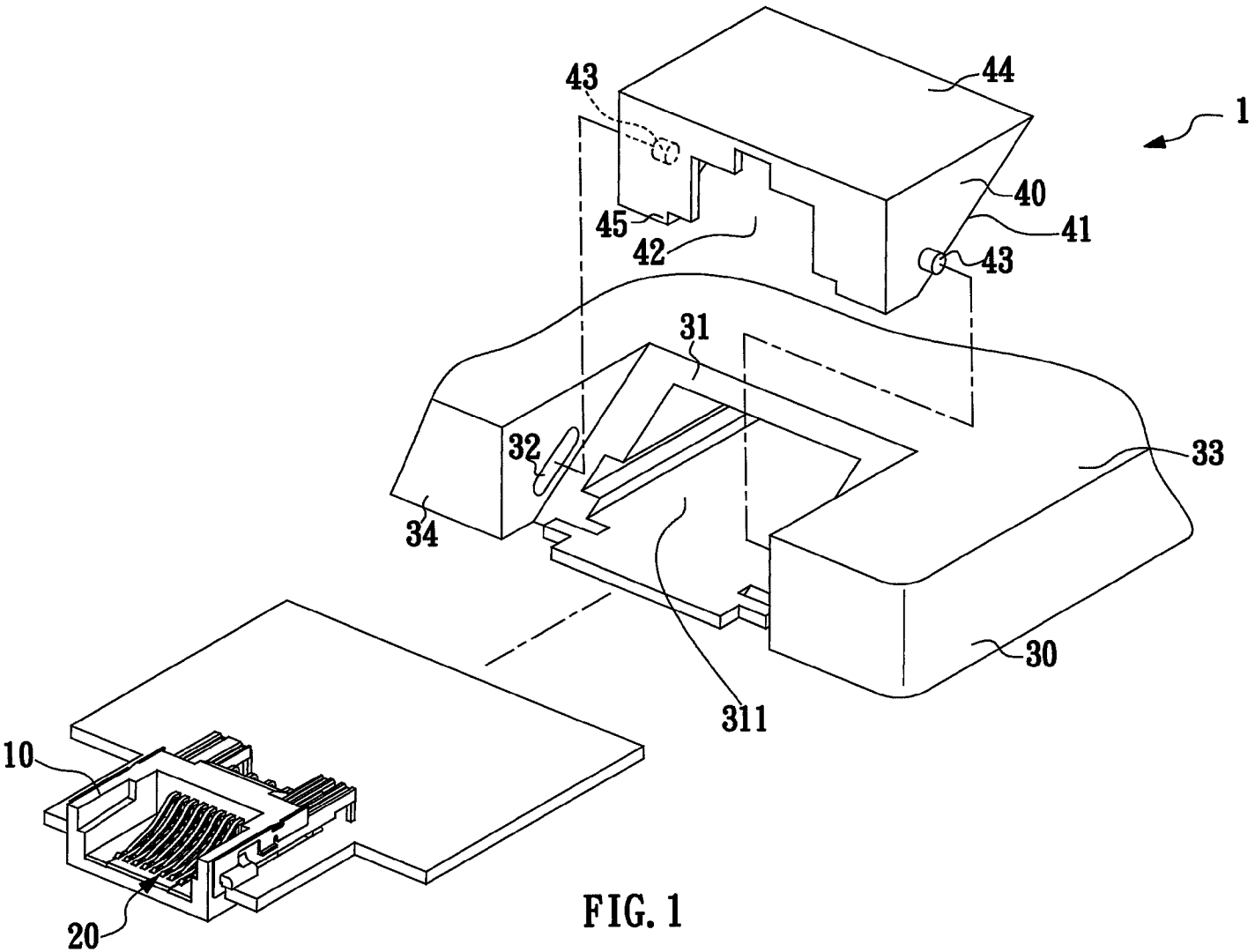
FIG. 1 illustrates an exploded perspective view of the communication connector of one embodiment of the present invention.
Figure 2:
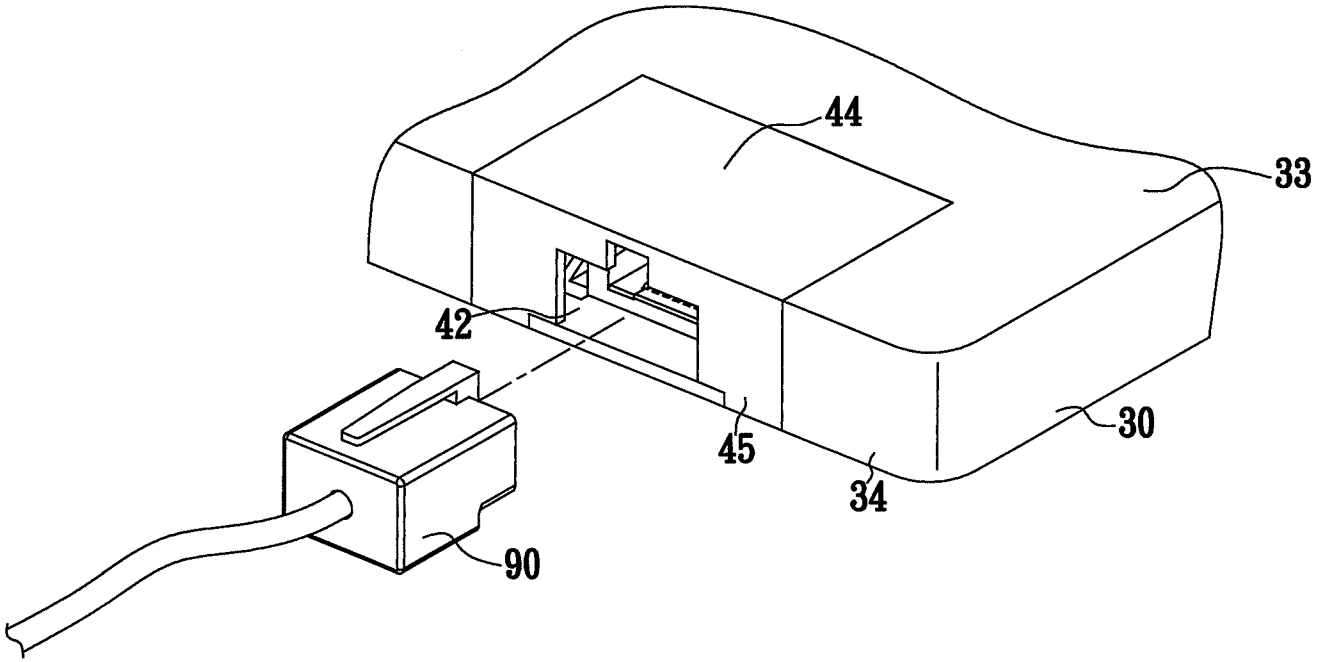
FIG. 2 illustrates a schematic drawing of the communication connector of one embodiment of the present invention before connecting to a communication plug.
Figure 3:
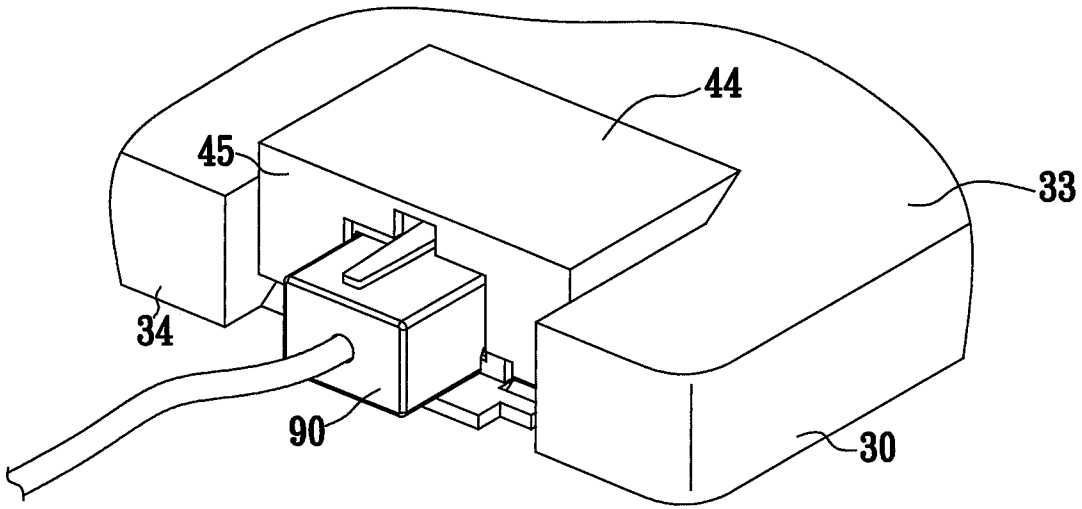
FIG. 3 illustrates a schematic drawing of the communication connector of one embodiment of the present invention after connecting to a communication plug.

Please refer to FIG. 1 to FIG. 3. FIG. 1 illustrates an exploded perspective view of the communication connector of one embodiment of the present invention. FIG. 2 illustrates a schematic drawing of the communication connector of one embodiment of the present invention before connecting to a communication plug. FIG. 3 illustrates a schematic drawing of the communication connector of one embodiment of the present invention after connecting to a communication plug.

As shown in FIG. 1 to FIG. 3, the communication connector 1 of the present invention is used for connecting with a communication plug 90. As shown in FIG. 1 and FIG. 2, the communication connector 1 of the present invention comprises a base 10, a set of conductive terminals 20, a case 30, and a cover 40. The set of conductive terminals 20 is situated on the base 10, and the case 30 is used for accommodating the base 10 and the set of conductive terminals 20. The case 30 comprises a first incline 31, at least one sliding slot 32, a case top surface 33, and a case side surface 34, wherein the first incline 31 comprises an opening 311. The cover 40 comprises a second incline 41, a notch 42, at least one guiding pin 43, a cover top surface 44, and a cover side surface 45, wherein the shape of the second incline 41 matches the first incline 31 to allow the cover 40 to move upward or downward relative to the case 30. The guiding pin 43 is located in the at least one sliding slot 32, and the tilt angle of the at least one sliding slot 32 is substantially same as the tilt angle of the first incline 31 in order to guide the cover 40 to move upward or downward relative to the first incline 31 of the case 30. As shown in FIG. 2 and FIG. 3, when the cover 40 moves upward, the communication plug 90 can pass the notch 42, enter the opening 311, and electrically connect to the set of conductive terminals 20. It is noted that the shape of the notch 42 will match the communication plug 90 in order to ensure that the communication plug 90 enters smoothly. Furthermore, the case 30 can be an outer shell of an electronic device or an external insulation shell of the communication connector 1; the tilt angle of the first incline 31 and the sliding slot 32 can be adjusted based on the height of the case 30, as long as the height of the cover 40 is sufficient for the communication plug 90 to pass the notch 42 and the opening 311 after the cover 40 moves upward.

According to one embodiment of the present invention, as shown in FIG. 1, the at least one sliding slot 32 is two sliding slots 32, which are located respectively on two sides of the first incline 31, and the at least one guiding pin 43 is two guiding pins 43, which are located on two sides of the second incline 41, respectively, but the present invention is not limited to that design. Furthermore, according to one embodiment of the present invention, the base 10 and the set of conductive terminals 20 of the communication connector 1 of the present invention are located on a printed circuit board.

This kind of combination is also known as the half style RJ45 connector; i.e., an RJ45 connector that has a connecting base but no upper cover.

As shown in FIG. 1 and FIG. 2, when the communication plug 90 is not electrically connected to the set of conductive terminals 20, the cover side surface 45 is at the same level as the case side surface 34. It is noted that in one embodiment of the present invention, when the communication plug 90 is not electrically connected to the set of conductive terminals 20, the height of the communication connector 1 of the present invention is substantially less than 12 mm.

As shown in FIG. 3, when the cover 40 moves upward, the communication plug 90 passes the notch 42, entering the opening 311 and electrically connecting to the set of conductive terminals 20, such that the network signal can be delivered, and at this moment, the cover top surface 44 is higher than the case top surface 33. It is noted that when the communication plug 90 is removed from the communication connector 1 of the present invention, the fastening force between the cover 40 and the communication plug 90 will be lost, consequently causing the cover 40 to move downward along the first incline 31, guided by the guiding pin 43 and the sliding slot 32, to cover the first incline 31 to form the state shown in FIG. 2. According to one embodiment of the present invention, the communication connector 1 of the present invention is an RJ45 connector, and the communication plug 90 is an RJ45 plug; however, the present invention is not limited to that design.

To sum up, the communication connector 1 of the present invention overcomes the thickness problem of the prior art, and the communication connector 1 of the present invention can be installed in thin electronic devices. Moreover, the operating method of the communication connector 1 of the present invention is easy in that the user has only to lift the cover 40 to allow the cover 40 to move upward, and then to plug in the communication plug 90 to access the wired network. Furthermore, when the communication plug 90 is removed from the communication connector 1, the cover 40 will move downward automatically until the cover 40 is at the same level as the case 30, such that the outward appearance of the case 30 can be flat and smooth, and not be limited to the thickness of the case 30.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A communication connector for connecting with a communication plug, comprising:

a base;

a set of conductive terminals situated on the base;

a case for accommodating the base and the set of conductive terminals, comprising a first incline, wherein the first incline comprises an opening; and a cover, comprising:

a second incline; the shape of the second incline matches the first incline, allowing the cover to move upward or downward relative to the case, and a notch; the shape of the notch matches the communication plug, wherein when the cover moves upward, the communication plug passes the notch, entering the opening, and electrically connecting to the set of conductive terminals.

2. The communication connector as claimed in claim 1, wherein the case comprises at least one sliding slot, and the cover comprises at least one guiding pin, wherein the at least one guiding pin is accommodated in the at least one sliding slot.

3. The communication connector as claimed in claim 2, wherein a tilt angle of the at least one sliding slot is substantially the same as a tilt angle of the first incline, for guiding the cover to move upward or downward relative to the case.

4. The communication connector as claimed in claim 1, wherein when the communication plug is not electrically connected to the set of conductive terminals, the cover can move downward to cover the first incline.

5. The communication connector as claimed in claim 1, wherein the cover comprises a cover top surface, and the case comprises a case top surface; when the cover moves upward, the cover top surface is higher than the case top surface.

6. The communication connector as claimed in claim 5, wherein when the cover moves downward, the cover top surface is at the same level as the case top surface.

7. The communication connector as claimed in claim 6, wherein the cover comprises a cover side surface, and the case comprises a case side surface; when the cover moves downward, the cover side surface is at the same level as the case side surface.

8. The communication connector as claimed in claim 1, wherein the communication connector is an RJ45 connector and the communication plug is an RJ45 plug.

9. The communication connector as claimed in claim 1, wherein the at least one sliding slot are two sliding slots and the two sliding slots are situated respectively on two sides of the first incline; the at least one guiding pin is two guiding pins, and the two guiding pins are situated respectively on two sides of the second incline.

10. The communication connector as claimed in claim 1, wherein when the communication plug is not electrically connected to the set of conductive terminals, a height of the communication connector is substantially less than 12 mm.

* * * * *